United States Patent [19]

Satterlee

[11] 4,282,506

[45] Aug. 4, 1981

[54] DEVICE FOR SENSING OVERHEATING OF BEARINGS

[76] Inventor: Jesse D. Satterlee, 1021 S. Oak St., Hillsboro, Ill. 62049

[21] Appl. No.: 49,215

[22] Filed: Jun. 18, 1979

Related U.S. Application Data

[63] Continuation-in-part of Ser. No. 846,328, Oct. 28, 1977, abandoned.

[51] Int. Cl.[3] ..... H01H 37/04; H01H 37/52

[52] U.S. Cl. ..... 337/380; 337/372

[58] Field of Search ..... 337/380, 381, 372, 113, 337/348, 3, 343, 365, 333

[56] References Cited

U.S. PATENT DOCUMENTS

| | | | |
|---|---|---|---|
| 4,059,817 | 11/1977 | Hollweck et al. | 337/365 |
| 4,091,354 | 5/1978 | Deubel et al. | 337/343 |

FOREIGN PATENT DOCUMENTS

| | | | |
|---|---|---|---|
| 118296 | 3/1947 | Sweden | 337/333 |

*Primary Examiner*—Harold Broome

*Attorney, Agent, or Firm*—Ralph F. Staubly

[57] ABSTRACT

A device for sensing overheating of bearings comprises a high-heat-conductivity metallic (copper) sheet adapted for shape-conforming fixed face-contact with an exposed surface of a bearing assemblage. A flat-bottomed brass cup is fixed to the upper surface of the copper sheet, as by pop-type rivets passing through flanges extending laterally from the cup bottom. A snap-disc thermostat lies within and against the bottom of the cup for good heat-exchange with the cup and with the sheet and thus with the bearing assemblage. The cup houses a pair of normally separated switch arms, one of which is engageable by a button of insulating material (attached to the thermostat disc) when the disc snaps to its bearing-overheated position. The device is housed by a piece of plastic tube that snugly embraces the end of the sheath of a two-wire insulated cable electrically connected to the switch. The tube's other end is split and is expanded over the cup and is fixed thereto by a high-temperature-resistant plastic electrically insulating packing material.

4 Claims, 4 Drawing Figures

DEVICE FOR SENSING OVERHEATING OF BEARINGS

This application is a continuation-in-part of applicant's abandoned identically entitled application Ser. No. 846,328, filed Oct. 28, 1977.

OBJECTS OF THE INVENTION

It is the object of this invention to provide a device for reliably sensing the overheating of bearings by the use of (1) a snap-acting switch for minimizing contact failure from arcing, and (2) materials and construction insuring good heat-transfer between a bearing assemblage and the sensing element. Other objects and advantages will become apparent as the following detailed description proceeds.

Figure 1:
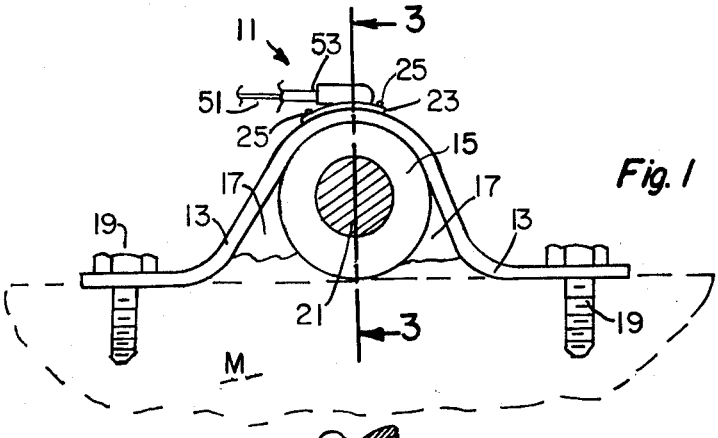
FIG. 1 is a side elevational view of a typical installation.
Figure 2:
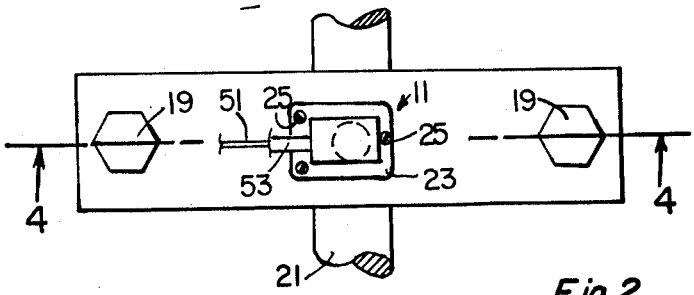
FIG. 2 is a plan view of the showing of FIG. 1.
Figure 3:
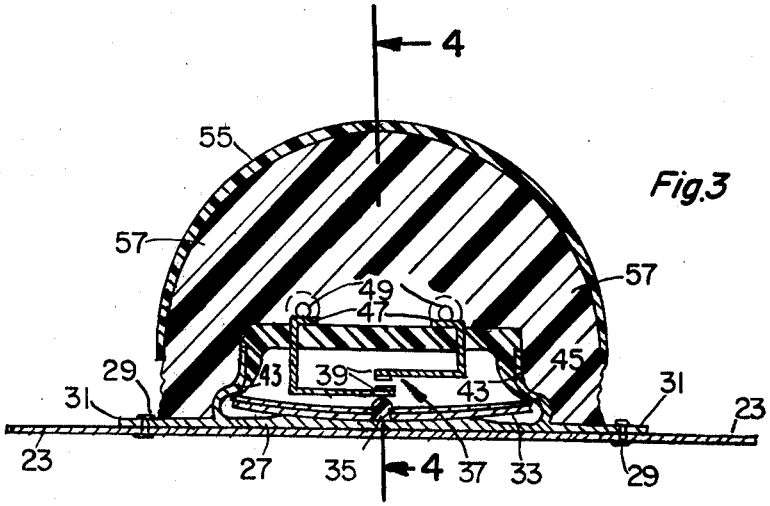
FIG. 3 is an enlarged elevational view of the device in section taken on the line 3—3 of FIG. 1.
Figure 4:
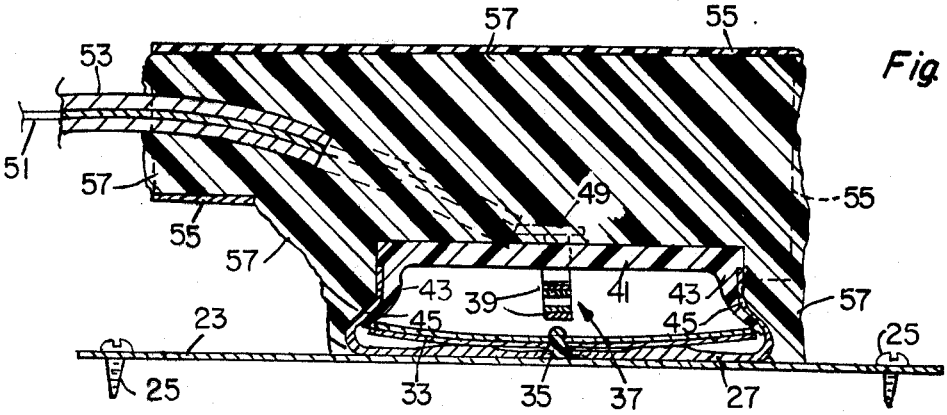
FIG. 4 is an enlarged elevational view of the device in section taken on the lines 4—4 of FIGS. 2 and 3.

With reference now to the drawings, the numeral 11 generally designates the sensing device, which in FIGS. 1 and 2 is shown as being mounted on an omega-shaped strap 13. The strap 13 has a bearing sleeve 15, attached thereto as by weld-deposited metal 17, and is fixed to the top of a machine body M by machine screws 19, to form a bearing assemblage for carrying a shaft 21.

The sensing device 11 comprises a base lamina 23 formed of a preferably non-resiliently deformable metal for better surface contact (as by peening) with the flat or curved surface of a bearing assemblage for improved heat-transfer. The metal also desirably is a very-high-heat-conductivity metal, such as a high-copper alloy or even "commercially pure" copper. The lamina 23 is attachable in shape-conforming contact with a surface of a bearing assemblage as by several self-tapping screws 25.

A brass cup 27 is fixed in good heat-transfer contact to the lamina 23 as by pop-type rivets 29 passing through laterally-extending integral flanges 31, or by soldering or brazing the flanges and/or the cup margin to the lamina 23 (not shown). The cup 27 has its bottom dished for better heat-transfer contact with a thermostatic disc 33 normally lying in the dished area, as shown. The disc 33 carries an insulating button 35 which closes a normally open switch 37 when the disc snaps centrally upwardly when heated to a preselected bearing-endangering temperature (e.g. 180 to 210 degrees F.).

The switch 37 comprises a pair of normally separated springarm contacts 39 carried by a disc 41 of electrically insulating material. The disc 41 has an integral downturned flange 43 which engages under the inturned lip 45 of the cup 27.

The horizontally bent upper ends 47 of the switch arms 39 are soldered to the ends 49 of the bared stranded wires 51 of the sheathed cable 53. The cable 53 is fixed to the device by passing snugly through one end of a piece 55 of high-heat-resistant plastic tube. The other end is split and expanded to fit over the cup 27 as a housing therefor. The space between the cup 27 and the housing part of the tube piece 55 is filled with a high-temperature-resistant plastic insulating material 57 (e.g. "DEVCON SEAL-IT"). The material 57 hardens into a somewhat elastic body which not only firmly and protectively assembles the parts of the device 11, but also thermally and electrically insulates the parts.

The noted very good heat-exchange between the thermostat and the bearing is provided by the noted selection of alloys and also by having the coplanar flange 31 greatly increase the heat-transfer area of the bottom of the cup 27, and by having the heat-transfer area of the high-copper pliably deformable lamina be double that of the cup and its coplanar flange.

The invention having been described, what is claimed is:

1. A device for sensing overheating of a bearing assemblage having a heat-dissipating surface, said device comprising: a large-area heat-transfer lamina made of a pliably deformable and very-high-heat-conductive high-copper alloy and adapted for attachment in intimate shape-conforming face-contact with and to said heat-dissipating surface of said bearing assemblage, a normally downwardly convex snap-acting bimetallic-disc thermostat, means positioning said thermostat in good heat-transfer relation to said heat-transfer lamina, and a normally open electric switch means positioned for circuit-closing by said thermostat when it snaps to its upwardly convex circuit-closing position in response to its being heated to a preselected potentially bearing-damaging temperature, said means for positioning said thermostat being a thin round cup-shaped metallic element U-shaped in axial cross-section and having at least one disc-edge-embracing groove therein close to and parallel to the bight portion of said metallic element, said thin metallic element having an integral coplanar flange surrounding said bight portion and greatly increasing its area for heat-exchange contact with said heat-transfer lamina, and said heat-transfer lamina having a bearing-surface-engaging area at least double that of said thin metallic element plus its integral coplanar flange.

2. A device according to claim 1, the alloy of said lamina being substantially commercial-grade pure copper for good heat-transfer and good heat-conduction to, through and from said lamina.

3. A device according to claim 1, the central upper surface of said thin metallic element being upwardly concave for good shape-conforming and heat-exchange contact with said thermostat when lying thereagainst in its normal cool condition.

4. A device according to claim 1 and additionally comprising a sheathed two-conductor cable connected to said switch means, a housing of high-temperature-resistant plastic material covering said cup and the attached end of said cable, and high-temperature-resistant plastic insulating packing-material filling the space between said housing and said cup and protectively interconnecting said housing and the parts housed therein.

* * * * *